United States Patent [19]

Roman

[11] Patent Number: 4,537,215

[45] Date of Patent: Aug. 27, 1985

[54] PORTABLE WINDING DEVICE FOR FLEXIBLE PIPE, PARTICULARLY FOR CARS, CARAVANS, COACHES, CRAFTS, BALCONIES AND SMALL GARDENS

[75] Inventor: Gianfranco Roman, Pasiano, Italy

[73] Assignee: Claber S.p.A., Fiume Veneto, Italy

[21] Appl. No.: 537,715

[22] Filed: Sep. 30, 1983

[30] Foreign Application Priority Data

Apr. 13, 1983 [IT] Italy ..... 21519/83[U]

[51] Int. Cl.[3] ..... B65H 75/34

[52] U.S. Cl. ..... 137/355.26; 137/355.16; 242/86

[58] Field of Search ..... 137/355.16, 355.2, 355.21, 137/355.22, 355.23, 355.26, 355.27; 242/86

[56] References Cited

U.S. PATENT DOCUMENTS

| | | | |
|---|---|---|---|
| 1,746,995 | 2/1930 | Edwards | 137/355.26 |
| 2,519,064 | 8/1950 | Palm | 137/355.22 |
| 3,820,559 | 6/1974 | Griffiths et al. | 137/355.26 |

FOREIGN PATENT DOCUMENTS

| | | | |
|---|---|---|---|
| 674648 | 11/1963 | Canada | 242/86 |
| 519840 | 4/1940 | United Kingdom | 242/86 |
| 617842 | 2/1949 | United Kingdom . | |
| 1104000 | 2/1968 | United Kingdom . | |
| 1299162 | 12/1972 | United Kingdom . | |
| 2072142 | 9/1981 | United Kingdom . | |

*Primary Examiner*—A. Michael Chambers
*Assistant Examiner*—Sheri Novack
*Attorney, Agent, or Firm*—Cushman, Darby & Cushman

[57] ABSTRACT

A fixed casing and a rotatable drum define an annular housing, in which a flexible pipe can be wound. The annular housing is provided with an inner opening for the passage of one end of the pipe and with an outer opening for extraction of the other end of the pipe. The casing and the drum are rotatably connected by a hollow axial pin shaped as a pipe fitting and suitable for connection, on one side, to said one end of the pipe and, on the other side, to a further pipe for connection to a water supply.

8 Claims, 2 Drawing Figures

I
7
40
6
F
3
20
25
17
26
4
21
2
16
1
24
18
29
F
5
31
34
35
36
33
F
39
F
38
32
37
30
19
24
28
23
22
41
26
8
F
F
9
26
I

PORTABLE WINDING DEVICE FOR FLEXIBLE PIPE, PARTICULARLY FOR CARS, CARAVANS, COACHES, CRAFTS, BALCONIES AND SMALL GARDENS

The present invention relates to a portable winding device for flexible pipe, particularly for cars, caravans, coaches, crafts, balconies and small gardens.

It is known the utility, if not the necessity, to have in many occasions small portable winding devices for flexible pipes, generally to be used for the water transport from a water supply to a more o less far employment point. This is true above all in the case of vehicles such as caravans and crafts, but the same holds true in general.

There are presently on the market some kinds of portable winding devices, which operate only as housing case for the flexible pipe during the use stops, there being necessary in the use the complete extraction of the pipe from the winding device for the successive connection of the same pipe to the water supply. At the end of the use it is then necessary to insert the pipe in the winding device with consequent waste of time, handling difficulties and so on.

The object of the present invention is to realize a portable winding device for flexible pipe, in which the pipe can permanently remain associated to the winding device, both during the use, while it is passed through by the water, and during the relative stops, not compromising on the other hand the easy and quick complete extraction of the pipe as well as its reinsertion, if so desired.

According to the invention such an object has been reached by means of a portable winding device characterized in that it comprises a fixed casing provided with gripping and hanging means and a rotating drum supported by said casing and shaped so as to define with said casing an annular housing for a flexible pipe which can be wound therein, said annular housing being provided with a first opening facing towards the center of the winding device for the passage of the receiving end of the pipe and of a second opening facing outwards for the extraction of the distributing end of the pipe and there being provided for said drum and said casing an axial connection and rotation hollow pin shaped as a pipe fitting and suitable for connection, on one hand, to said pipe receiving end and, on the other hand, to a pipe for connection to the water supply.

It is evident that such a kind of winding device is not only destined to function as pipe casing during the rest times, but it is destined on the contrary to always contain the same pipe, both at rest and during the use, operating at the same time as containing casing, as support, as pipe supply and as element for connection to the water supply. It is not necessary at all to completely remove the pipe at the time of the use (and then to reinsert it), but it is sufficient to remove only the necessary length, while the remaining part is still housed in the winding device and at the same time connected to the water feed by means of a connection pipe of opportunely variable length. It is thus possible to reach any distance from the water supply, while the winding device remains available for the reintroduction of the removed part at the end of the use.

Obvious are the resulting advantages, particularly in view of the little space usually available in caravans, crafts and so on, and even of the little operative capacity of the users.

Being provided with gripping and hanging means, the winding device according to the invention can substantially remain hung to a wall or can be brought each time in the place of use, it can always have the pipe connected to the water supply or connected to it only when required, it can supply the desired pipe length while keeping the rest of the pipe inside. It will never be necessary to completely remove the pipe from the winding device and consequently to have a long and bulky pipe on one hand and a similarly bulky and loosable winding device on the other hand. This does not prevent that, if one wants, it is also allowed the complete extraction of the pipe, for example for a possible repair or replacement. Finally the winding device according to the invention is an object extremely suitable for the uses to which it is destined.

The characteristics and the advantages of the present invention will be made more evident by the following detailed description of an embodiment illustrated by way of non limitative example in the enclosed drawings, in which.

Figure 1:
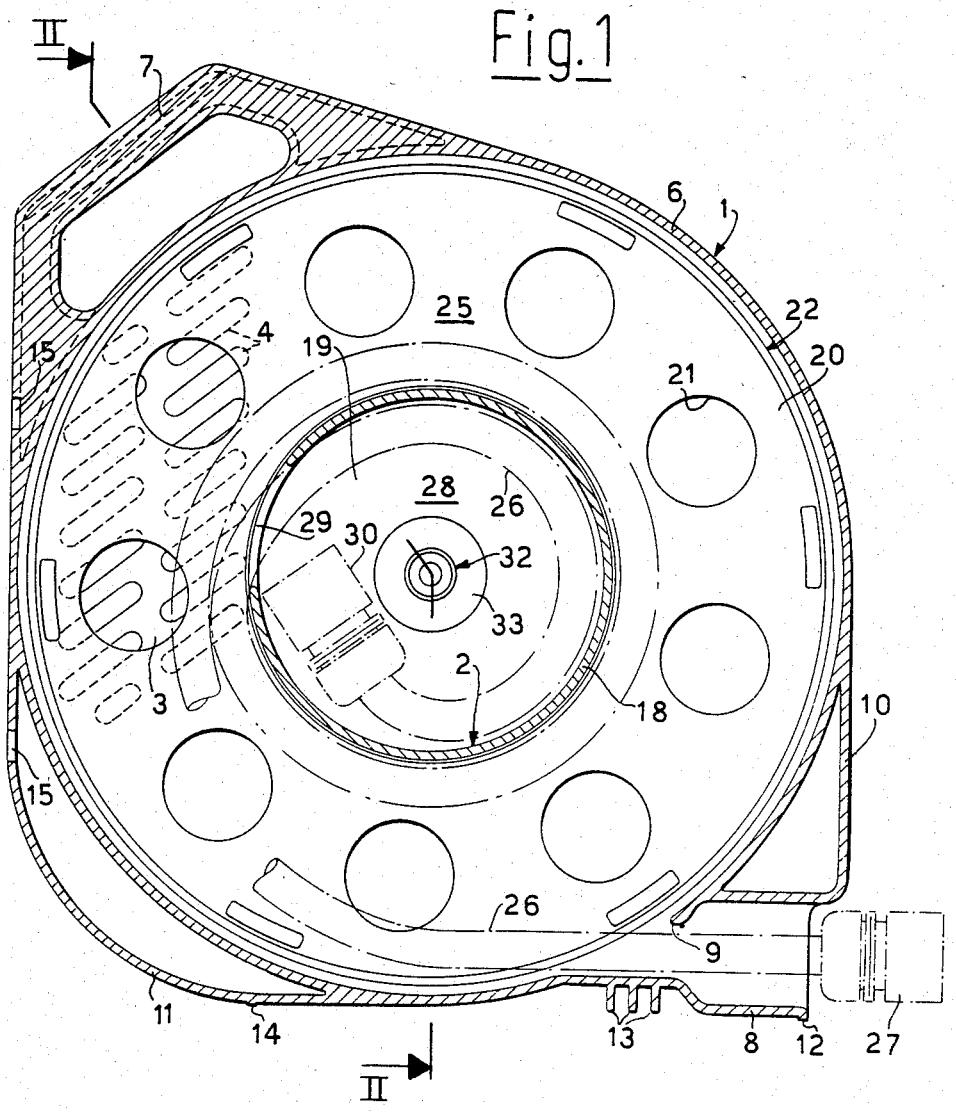
FIG. 1 shows a winding device in transversal section with respect to the rotation axis, along line I—I of FIG. 2.

The portable winding device illustrated in the drawings substantially comprise a fixed casing 1 and a rotating drum 2, both in moulded plastic material.

Figure 2:
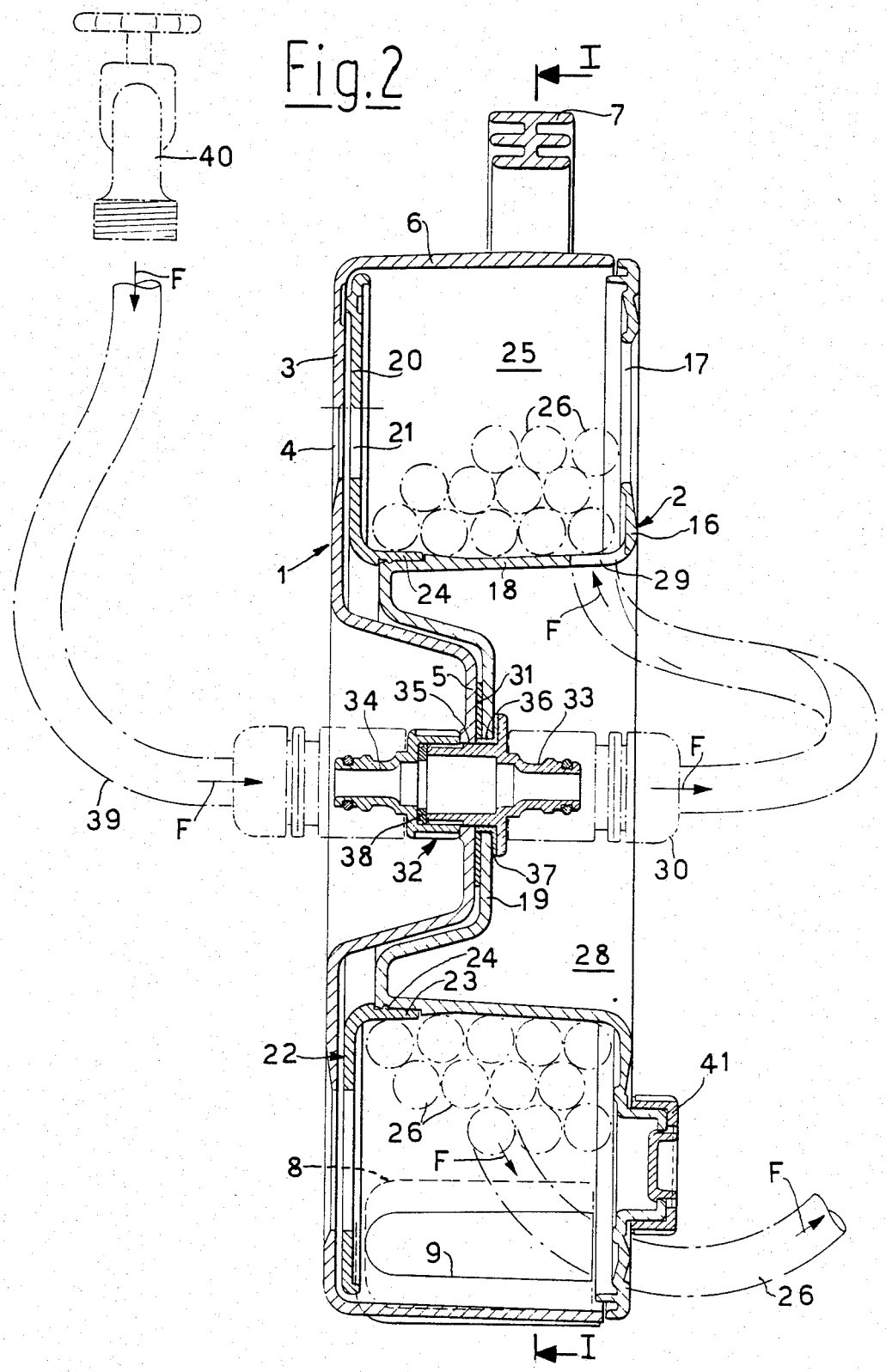
FIG. 2 shows said winding device in axial section along line II—II of FIG. 1.

The casing 1 has a plane annular part 3, provided with holes and slots 4, which connects a projecting central part 5 to a circular peripheral wall 6 disposed perpendicularly to the annular part 3 (FIG. 2). With the above mentioned peripheral wall there form a single block (FIG. 1) a gripping handle 7, of trapezoid shape, an extraction mouth 8, tangentially facing outwards and communicating with the inside of the casing 1 through an opening 9, a rib 10 with stiffening functions, for the mouth 8 and finally a rib 11 able to define support planes for the casing 1 in combination with the mouth 8 and the handle 7. Of the above mentioned support planes, defined on adjacent sides of the casing 1, the first one is destined for the real stable rest on the ground or other analogous surface and for such object makes use of turns or feet 12, 13 and 14 of the mouth 8 and of the same rib 11, while the second one is destined for the approaching to a vertical wall and for such object it is provided with slots 15 for the hanging of the casing 1 to suitable suspension means.

The drum 2 presents in its turn, at suitable distance from the corresponding plane annular part 3 of the casing 1, a plane annular part 16 provided with circumferentially spaced holes 17, which part 16 is connected by a perpendicular circular wall 18 to a recessed central part 19, which receives the corresponding projecting central part 5 of the casing 1 (FIG. 2). To the above mentioned annular part 16 there corresponds, near the annular part 3 of the casing 1, a similar plane annular part 20 (also provided with circunferentially spaced holes 21) of a plate or closing counter-flange 22 provided with a turned central portion 23 releasably snaply connected at 24 to the circular wall 18 of the drum 2 (FIG. 2).

The above mentioned annular parts of the drum 2 and of the plate 22, together with the peripheral wall 6 of the casing 1, thus form an annular housing 25, in which there can be inserted and wound a flexible pipe 26 illustrated by way of example in dash and dot line in FIGS. 1 and 2. The above mentioned housing communicates with the outside through the above mentioned opening 9, which serves for the extraction of the distributing end 27 of the pipe 26, and also communicates with the space 28 defined inside the circular wall 18 of the drum 2 through an opening 29 of the same wall (FIG. 1), which serves for the passage of the receiving end 30 of the pipe 26 (normally housed in the above mentioned space).

The casing 1 and the drum 2 are rotatably connected to each other, at the respective central parts 5 and 19 with interposed friction washer 31, by means of a hollow axial pin 32 which also operates as a pipe fitting. More precisely, the hollow pin 32 is formed by two male connection elements 33 and 34, the first one of which passes through aligned central holes 35 and 36 of the two coupled parts 5 and 19 and the second one is screwed on the first one on the opposite side (FIG. 2), a sliding bush 37 being interposed between the male element 33 and the recessed part 19 of the drum 2 and a gasket 38 being interposed between the two male elements 33 and 34. As schematically illustrated in FIG. 2, the male element 33 is destined for the connection of the receiving end 30 of the flexible pipe 26, while the male element 34 is destined for the connection of a flexible pipe 39 for the connection to a water supply 40.

On the plane annular part 16 of the rotating drum 2 there is finally applied a small knob 41, which serves for the manual rotation of the same drum.

In normal rest conditions, the portable winding device illustrated in the drawings is destined for containing the flexible pipe 26, with the receiving end 30 of this latter (opportunely provided with female fitting, as shown) housed in the space 28. In such conditions the winding device will preferably be connected to a support hook by means of the handle 7. The pipe 26 could have been charged in different ways, for example, by separating the casing 1 from the drum 2 after separation of the two connection elements 33 and 34 and by provisionally removing the plate 22.

At the moment of the use, once situated the winding device in the most suitable position (put on the ground or hooked at a wall through the slots 15), there is carried out the hydraulic connection of the male fitting 34 to the water supply 40 through a flexible pipe 39 and that of the receiving end 30 of the pipe 26 to the male fitting 33, such as illustrated in FIG. 2. At that point, by applying a tensile stress to the distributing end of the pipe 26 and making use of the rotation of the drum 2, one can take out from the winding device through the mouth 8 the desired length of the pipe 26, leaving the exceeding part still wound in the housing 25 of the winding device. In FIG. 2 the arrows F illustrate the passage of the water from the water supply 40 to the fitting 32 and then through the flexible pipe 26. If desired, the pipe 39 can lack and the receiving end 30 of the pipe 26 can be directly connected to the water supply 40.

At the end of the use the previously removed pipe length is reinserted in the winding device, by suitably rotating the drum 2 by means of the knob 41.

I claim:

1. A portable winding device for flexible pipe, comprising a fixed casing provided with gripping and hanging means and a drum rotatable on a support conduit, the drum shaped so as to define with said casing an annular housing for a flexible pipe which can be wound therein, the annular housing being provided with a first opening facing toward the center of the winding device for the passage of the receiving end of the pipe and a second opening facing outwards for the extraction of the distributing end of the pipe, the support conduit axially connecting the casing and the drum, the support conduit provided with a coupling at one end, capable of coupling to the flexible pipe, the support conduit provided with a second coupling at the opposite end capable of coupling to a fluid supply, each of the couplings being situated such that they are readily accessible from the exterior of the winding device, the casing further comprising a first plane annular member, a projecting central member supported on said support conduit and a circular peripheral wall disposed perpendicular to said annular member, the drum comprising a second plane annular member spaced parallel to said first plane annular member, an annular wall disposed perpendicular to and spaced from said peripheral wall, a recessed central member receiving said projecting central member and rotatably supported on said support conduit.

2. Portable winding device according to claim 1, characterized in that to said drum is releasably coupled a closure plate including a plane annular part placed parallelly to said plane annular part of the drum far from it and near said plane annular part of the casing.

3. Winding device according to claim 1, characterized in that said first opening is obtained in said circular wall of the drum and said second opening is obtained in said circular peripheral wall of the casing.

4. Portable winding device according to claim 1, characterized in that said casing is shaped so as to provide a plane side for the steady support of the winding device on the ground or similar surface.

5. Portable winding device according to claim 1, characterized in that said gripping and hanging means comprise a handle integral with said peripheral wall of the casing.

6. Portable winding device according to claim 5, characterized in that said gripping and hanging means also comprise hanging slots obtained on another plane side of said casing.

7. Portable winding device according to claim 1, characterized in that said hollow axial pin is formed by two counterposed fitting elements passing through aligned holes of said central parts of the casing and of the drum and screwed one on the other.

8. Portable winding device according to claim 1, characterized in that to said plane annular part of the drum is fixed a knob for the manual rotation of the drum.

* * * * *